US007762351B2

(12) United States Patent
Vidal

(10) Patent No.: US 7,762,351 B2
(45) Date of Patent: Jul. 27, 2010

(54) EXPOSED HOLLOW CARRIER PERFORATION GUN AND CHARGE HOLDER

(76) Inventor: Mirabel Vidal, P. O. Box 188, Cd. del Carmen, Campeche (MX) CP 24100

( * ) Notice: Subject to any disclaimer, the term of this patent is extended or adjusted under 35 U.S.C. 154(b) by 0 days.

(21) Appl. No.: 12/250,042

(22) Filed: Oct. 13, 2008

(65) Prior Publication Data

US 2010/0089643 A1 Apr. 15, 2010

(51) Int. Cl.
*E21B 29/08* (2006.01)

(52) U.S. Cl. ..... 175/4.6

(58) Field of Classification Search ..... 175/4.6; 89/1.15; 102/313
See application file for complete search history.

(56) References Cited

U.S. PATENT DOCUMENTS

| | | | | |
|---|---|---|---|---|
| 2,062,975 | A | | 12/1936 | Lane |
| 2,494,256 | A | | 1/1950 | Muskat et al. |
| 2,649,046 | A | | 8/1953 | Davis |
| 2,680,406 | A | | 6/1954 | Austin |
| 2,686,472 | A | | 8/1954 | Burns |
| 2,734,456 | A | | 2/1956 | Sweetman |
| 3,040,659 | A | | 6/1962 | McCullough |
| 3,269,467 | A | | 8/1966 | Bell |
| 3,468,386 | A | | 9/1969 | Johnson |
| 3,528,511 | A | | 9/1970 | Boop et al. |
| 3,589,453 | A | | 6/1971 | Venghiattis |
| 3,659,658 | A | | 5/1972 | Brieger |
| 3,695,368 | A | | 10/1972 | Lanmon, II |
| 3,762,326 | A | | 10/1973 | Edgell et al. |
| 3,991,836 | A | | 11/1976 | Bouguyon et al. |
| 4,140,188 | A | | 2/1979 | Vann |
| 4,534,423 | A | | 8/1985 | Regalbuto |
| 4,583,602 | A | | 4/1986 | Ayers |
| 4,635,734 | A | | 1/1987 | Donovan et al. |
| 4,658,900 | A | * | 4/1987 | Stout ..... 166/297 |
| 4,747,201 | A | | 5/1988 | Donovan et al. |
| 4,850,438 | A | | 7/1989 | Regalbuto |
| 4,881,445 | A | | 11/1989 | Hayes |
| 5,007,486 | A | | 4/1991 | Ricles |
| 5,070,943 | A | | 12/1991 | Walker et al. |
| 5,542,480 | A | | 8/1996 | Owen et al. |
| 5,544,711 | A | | 8/1996 | Aitken et al. |

(Continued)

*Primary Examiner*—William P Neuder
(74) *Attorney, Agent, or Firm*—Decker Jones, et al; Brian K. Yost

(57) ABSTRACT

The perforation gun is comprised of a tubular carrier, a charge holder, a plurality of sealed charges, and a detonating cord. The tubular carrier has a length and a plurality of openings. The charge holder has a length and is comprised of a plurality of mounting locations which are each capable of receiving one of the sealed charges. The charge holder is capable of being secured within the carrier. The detonating cord is coupled to at least one sealed charge. In the mounted position and when the charge holder is secured within the carrier, the charges are aligned with the openings in the carrier such that, upon detonation, charge blasts emitted from the charges exit though the carrier openings and perforate a well casing and cement. In one aspect of the invention, the carrier openings are spirally arranged and spaced along the length of the carrier. In still another aspect of the invention, the openings are vertically arranged and spaced along the length of the carrier. In still another aspect of the invention, the carrier is closed at the top and bottom. In still another aspect of the invention, the carrier is capable of capturing debris created by a charge blast emitted from the sealed charges.

8 Claims, 6 Drawing Sheets

U.S. PATENT DOCUMENTS

| | | | | |
|---|---|---|---|---|
| 5,638,901 | A | 6/1997 | Shirley et al. | |
| 5,775,426 | A * | 7/1998 | Snider et al. | 166/308.1 |
| 6,220,355 | B1 | 4/2001 | French | |
| 6,289,991 | B1 | 9/2001 | French | |
| 6,554,081 | B1 * | 4/2003 | Brooks et al. | 175/4.54 |
| 6,591,911 | B1 | 7/2003 | Markel et al. | |
| 6,851,471 | B2 * | 2/2005 | Barlow et al. | 166/55.2 |
| 7,152,676 | B2 | 12/2006 | Vella et al. | |
| 7,278,484 | B2 | 10/2007 | Vella et al. | |
| 2002/0096040 | A1 * | 7/2002 | Barker et al. | 89/1.15 |
| 2005/0211467 | A1 * | 9/2005 | Ratanasirigulchia et al. | 175/4.5 |
| 2006/0196693 | A1 * | 9/2006 | Bell et al. | 175/4.5 |
| 2007/0107589 | A1 * | 5/2007 | Rospek et al. | 89/1.15 |
| 2007/0158109 | A1 | 7/2007 | Zazovsky et al. | |
| 2008/0295678 | A1 * | 12/2008 | George et al. | 89/1.151 |
| 2009/0050323 | A1 * | 2/2009 | Walker | 166/297 |

* cited by examiner

EXPOSED HOLLOW CARRIER PERFORATION GUN AND CHARGE HOLDER

BACKGROUND OF THE INVENTION

1. Field of the Invention

The present invention relates to a perforation gun with a partially hollow carrier aspect.

2. Description of the Prior Art

After a well is drilled and casing has been cemented in the well, one or more formation zones of interest may be found. Unless the casing, cement, and formation are penetrated, fluid found within the formation zone cannot flow into the well. Oil and gas well operators have, therefore, found it necessary at times to perforate the well casing, cement, and surrounding formations in order to bring the well into production.

Several devices are known in the art to help accomplish this task. One such device, a perforation gun, comprises a strip of high energy explosive charges that may be lowered into the well to the desired depth. These charges are often phased to fire in multiple directions around the circumference of the wellbore. When fired, these charges create explosive jets that penetrate the well casing, cement, and formation. Production fluids in the perforated formation may then flow through the perforations and into the wellbore.

Some perforation guns are comprised of a strip of shaped charges held in a predetermined position within a charge holder. Such charge holders may or may not be contained within an elongated, cylindrical carrier. When found within such a carrier, non-capsule shaped charges are used. These charges are pressure sensitive and, therefore, must be contained within a pressure sealed carrier. The charges are typically positioned within such a carrier so that they are aligned in a pattern to allow each charge to penetrate a different portion of the casing. Because the charges, once detonated, penetrate the carrier as well as the casing, the carrier may become deformed. In such a case, the perforation gun may become lodged in the wellbore and difficult to retrieve.

In an effort to eliminate this problem, some prior art perforation guns contain charges aligned with thinner areas of the carrier. These thinner areas, or scallops, maintain the pre-detonation carrier pressure seal, but allow the charge, upon detonation, to more easily penetrate the carrier body. Scalloped perforation guns still require the charge to penetrate the carrier which reduces the amount of force entering the casing. Unfortunately, because of internal pressures generated within the gun during detonation, scalloped carriers may become deformed. In an extreme case, a scalloped carrier gun may, before detonation, lose its pressure seal, thus exposing the non-pressure sealed charges to wellbore fluids. Upon detonation, severe and even catastrophic damage to the carrier and wellbore may result.

An additional known problem with scalloped carrier perforation guns involves aligning the charges with the scallops. A sealed carrier prevents the user from visually confirming that the charges are properly aligned with the scallops. Therefore, occasionally a scalloped carrier perforation gun is improperly armed because the charges are directed at non-scalloped areas. This results in, upon detonation, severe damage to the carrier and inadequate casing penetration.

In an effort to reuse the carrier, some perforating guns are comprised of a cylindrical carrier with removable port plugs aligned with the charges, to seal the gun. These types of guns use non-capsule shaped charges. However, these plugs are known to occasionally allow well fluid to enter the gun, which may cause severe damage to the carrier upon detonation.

Other perforation guns are comprised of charges mounted on the gun carrier which is normally a retrievable strip section. The charges used in these guns are capsule shaped charges which are pressure sealed. Capsule shaped charges are individually mounted within the carrier wall with threaded or other type couplings. Because of the forces acting at different directions during detonation and because of weaknesses in the strip, these guns may suffer damage upon detonation and become difficult to retrieve.

Other perforating guns are comprised of charges mounted in a weak expendable gun carrier (normally wires), which are totally destroyed upon detonation and left in the well. The charges used in this type of gun are capsule shaped charges which are pressure sealed. Because of weaknesses in such gun carriers, it is sometimes difficult to lower the gun to the desired depth. These guns also have a high potential of becoming lodged within the wellbore prior to detonation. Additionally, following detonation, all of the contents of the gun, including the charges and gun carrier, form debris which is necessarily, but undesirably, left in the well.

What is needed is a perforation gun that is easily assembled and armed, permits a maximum amount of charge energy to penetrate the casing, cement, and formation, is retrievable, prevents debris from accumulating in the wellbore after detonation, and has a reusable carrier that is not deformed after detonation.

SUMMARY OF THE INVENTION

It is an object of the invention to provide a perforation gun that is easily assembled and armed, that does not reduce the penetration power of the charges, that is retrievable, that prevents debris from accumulating in the wellbore after detonation, and that has a reusable carrier that is not deformed after detonation.

The present invention provides a perforation gun comprising of a carrier and a charge holder. The carrier has a plurality of spirally positioned openings that allow charge blasts to exit the carrier and perforate a well casing and surrounding formation. The charge holder is comprised of a helical strip containing capsule shaped pressure sealed charges, a detonating cord, and a conventional detonation system. The capsule shaped pressure sealed charges are spirally positioned so that each charge aligns with a corresponding opening in the carrier. Upon detonation, each charge emits a charge blast that exits through the carrier openings, and perforates the well casing, forming a casing perforation. Collectively, the perforations formed by each of the charge blasts allow fluids previously confined within the producing formation to flow from the formation into the wellbore.

In accordance with another aspect of the present invention, the carrier openings are positioned at a zero degree phase, the charge holder is an elongated strip, and the sealed charges are positioned at a zero degree phase so as to align with corresponding openings in the carrier.

In accordance with another aspect of the present invention, the carrier openings are vertically positioned at a forty degree phase, and the sealed charges are positioned at a forty degree phase so as to align with corresponding openings in the carrier.

In accordance with another aspect of the present invention, the carrier openings are vertically positioned at a forty-five degree phase, and the sealed charges are positioned at a forty-five degree phase so as to align with corresponding openings in the carrier.

In accordance with another aspect of the present invention, the carrier openings are vertically positioned at a sixty degree phase, and the sealed charges are positioned at a sixty degree phase so as to align with corresponding openings in the carrier.

In accordance with another aspect of the present invention, the carrier openings are positioned at a seventy-two degree phase, the charge holder is an elongated strip, and the sealed charges are positioned at a seventy-two degree phase so as to align with corresponding openings in the carrier.

In accordance with another aspect of the present invention, the carrier openings are positioned at a ninety degree phase, the charge holder is an elongated strip, and the sealed charges are positioned at a ninety degree phase so as to align with corresponding openings in the carrier.

DESCRIPTION OF THE PREFERRED EMBODIMENT

Figure 1:
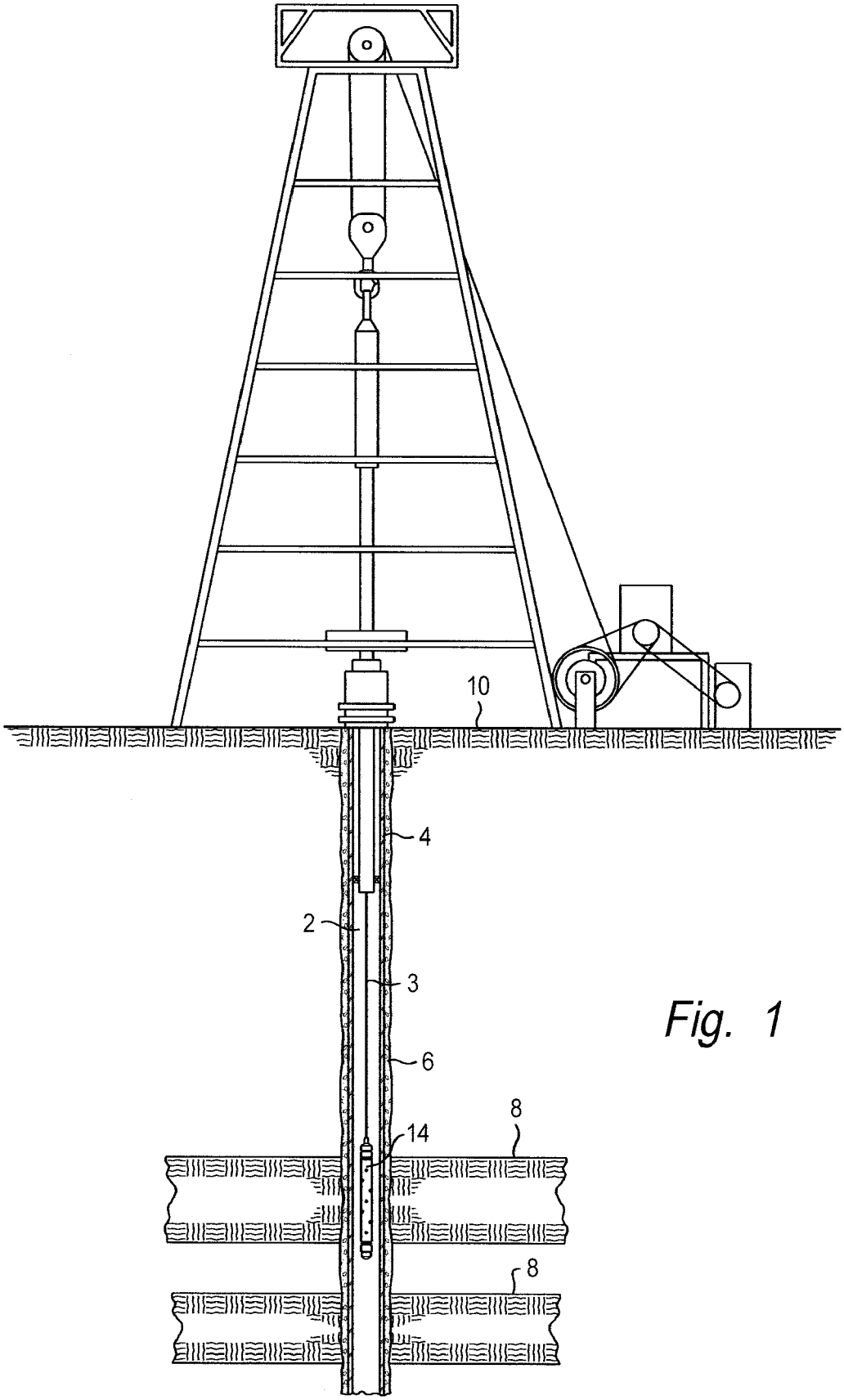
FIG. 1 is a cross-sectional view of a wellbore with casing extending through various geologic formations, a wireline, and a perforation gun suspended from the wireline.

Referring to FIG. 1, there is shown a cross-sectional, side view of a wellbore 2 and casing 4, the wellbore 2 penetrating various zones, including the producing formations 8 found below the surface 10. The perforation gun 14 of the present invention allows the well operator to perforate the casing 4 and cement 6 adjacent to the producing formation 8 so that fluids confined within said formation may enter the wellbore 2 and be brought to the surface 10.

Referring to FIGS. 2-5B, a preferred embodiment of the perforation gun 14 is comprised of a carrier 16 and a charge holder 18. Generally, the carrier 16 has a plurality of spirally positioned openings 20 that allow charge blasts to exit the carrier 16 and perforate a well casing 4, cement 6, and surrounding formation 8. The charge holder assembly 18 is comprised of a helical strip 22, pressure sealed charges 24, a detonating cord 26. The capsule shaped pressure sealed charges 24 are spirally positioned so that each charge 24 aligns with a corresponding opening 20 in the carrier 16.

As may be seen in FIGS. 2-6, the charge holder 18 is comprised of a plurality of charge retaining plates 30. In the preferred embodiment, these plates 30 are rectangular and constructed from steel. However, these charge retaining plates 30 need not be rectangular, nor need they be constructed from steel. Rather, they may be constructed from aluminum, polyvinylchloride (PVC) or any other suitable material and may be in a variety of shapes.

Figure 6:
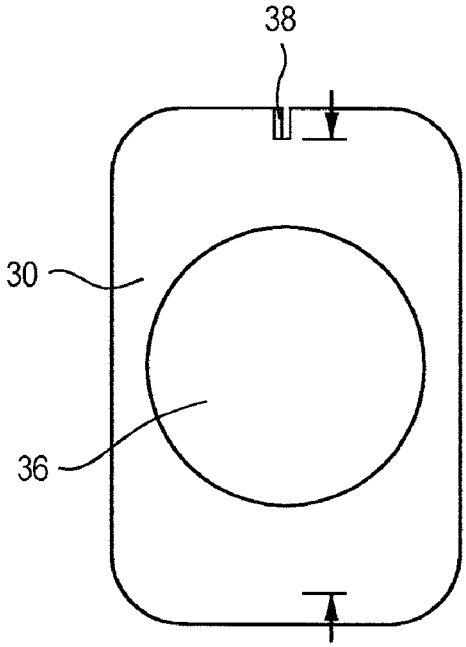
FIG. 6 is a front elevation view of one of the charge plates that retain the sealed charges of the perforation gun in accordance with a preferred embodiment.

The plates 30 of the preferred embodiment are generally rectangular and approximately 2¼"×2"×⅛" in size. Referring to FIG. 6, each plate 30 has an opening 36 capable of receiving a shaped charge 24, which in the preferred embodiment is in the plate's 30 approximate center. The shaped charges 24 of the preferred embodiment are generally cylindrical and have an anterior end from which, upon detonation, the charge blast exits, and a dorsal end having an aperture for receipt of a detonating cord 26. The plate opening 36 is slightly larger than the shaped charge 24, so that upon insertion, the charge 24 is frictionally held in place by the inner walls of the opening 36.

Each plate 30 is coupled to an adjacent plate 30 such that the axial centers of the plates 30 are at least parallel. In the preferred embodiment, the axial centers of the plates 30 are collinear. The plates 30 of the preferred embodiment are welded together so as to collectively form the helical strip 22. In the preferred embodiment this helical strip 22 is right handed, but may also be left handed.

Figure 6A:
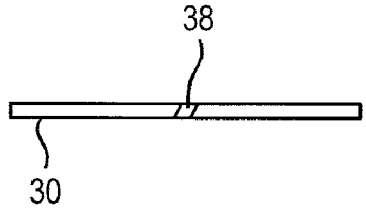
FIG. 6A is a top side view of the charge plate of FIG. 6.

As may be seen in FIGS. 6 and 6A, each plate 30 has at least one slot 38 slightly larger than the depth of the plate 30. Each slot 38 is approximately ⅛ inch deep and transects the plate 30 at an angle. In a preferred embodiment, this slot 38 transects at a 60 degree angle which, as will be discussed below, allows the charges 24 to be positioned so that, upon final assembly, each charge 24 aligns with an opening 20 in the carrier 16. During assembly of the helical strip 22, the lower portion of a first plate 30 is inserted into the slot 38 located on the upper portion of a second plate 30 and the two plates 30 are then welded together. In the preferred embodiment, a total of seven plates 30 comprise the helical strip 22. However, the number of the plates 30 is dependent upon the gun length and desired number of shots per foot. The shot arrangement of the preferred embodiment is six per foot. Some common gun lengths include twenty-one, ten, seven, and five foot lengths. In another embodiment of the present invention, a twenty-one foot gun has a six shot arrangement and approximately 126 plates 30. As may be seen in FIG. 2, in the seven plate arrangement of the preferred embodiment wherein each plate 30 is phased sixty degrees from the plate 30 below, the upper first plate 34 and lower seventh plate 32 are oriented at the same angle due to the full 360 degree turn of the helical strip 22.

Although the charge holder 18 of the preferred embodiment is formed from a welded series of plates 30 having slots 38, it need not be so formed. For example, the plates 30 may be coupled in any number of ways with and without slots 38 with any number of fasteners, including glue or other mechanical fasteners. Moreover, the charge holder 18 may be formed out of a single length of material rather than a series of conjoined plates 30. The charge holder 18 may also be cylinder shaped with the individual charges coupled with the holder's 18 cylindrical walls.

Figure 2:
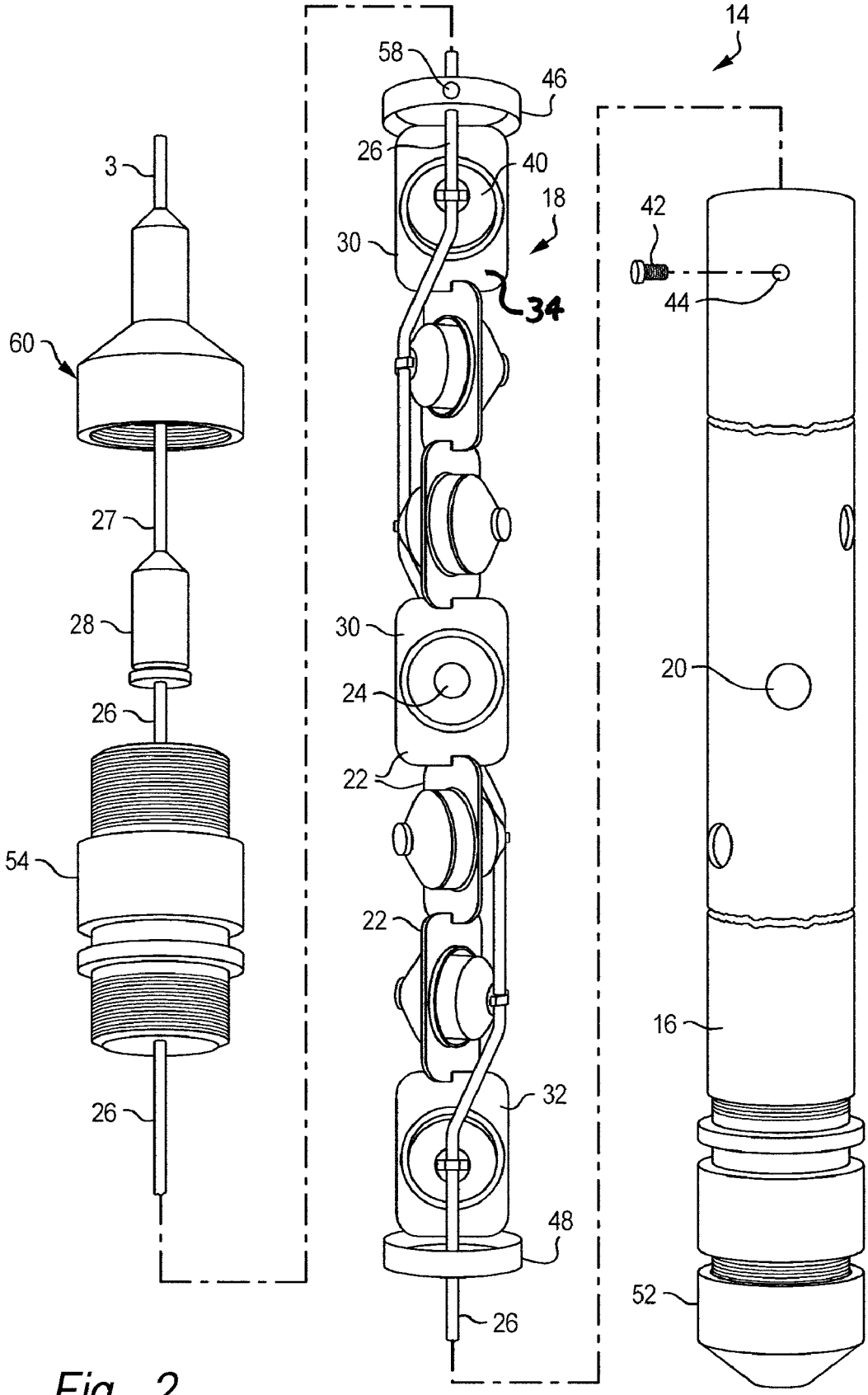
FIG. 2 is an exploded side view of the perforation gun, partially disassembled, and depicting the charge holder and charges separated from the carrier, in accordance with a preferred embodiment.
Figure 3:
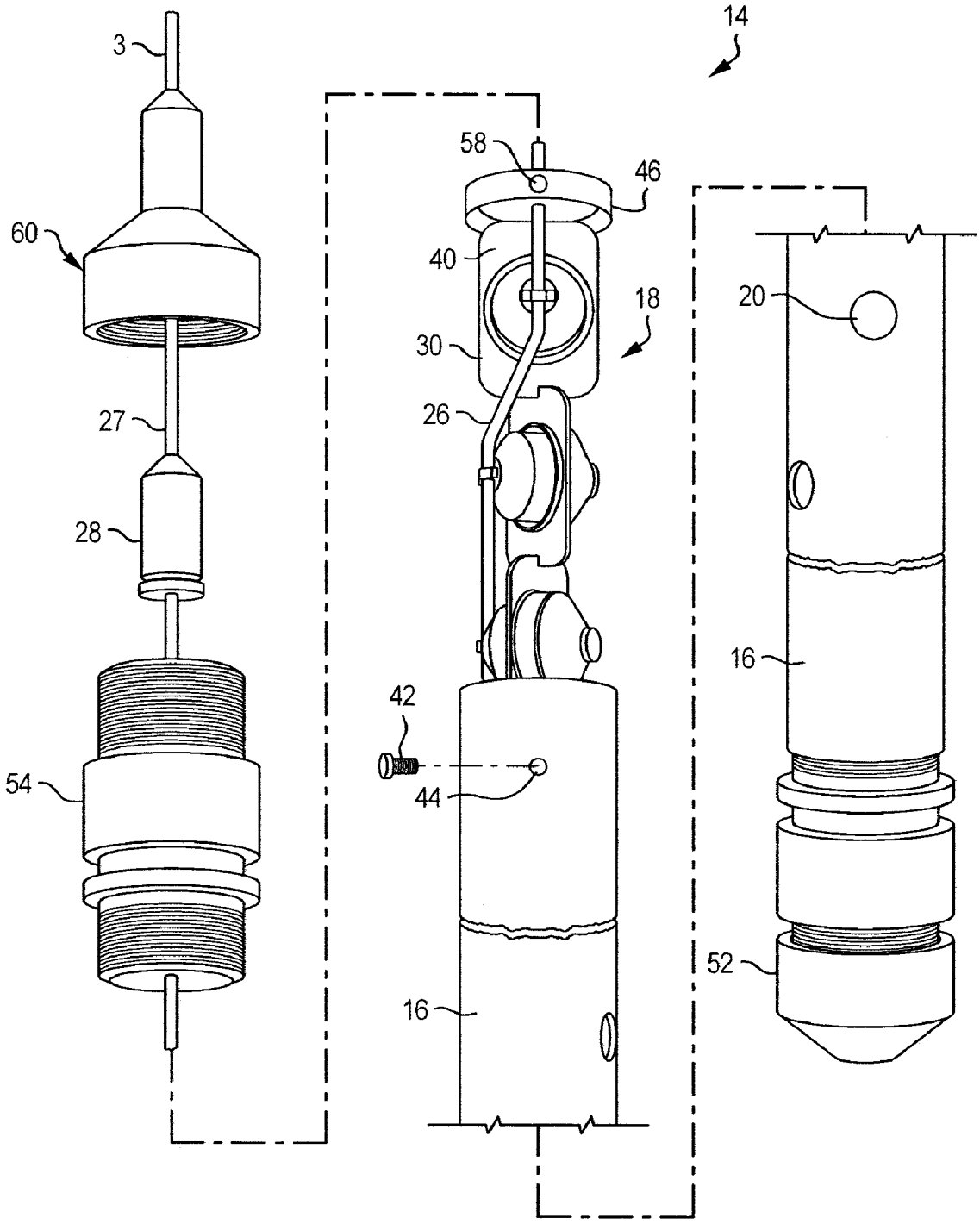
FIG. 3 is a side view of the perforation gun, partially disassembled, and depicting the charge holder and charges partially inserted within the carrier, in accordance with a preferred embodiment.

Referring to FIG. 2, the charge holder 18 of the preferred embodiment is further comprised of an upper centralizing disk 46 and a lower centralizing disk 48. These disks 46, 48 each have a diameter that is slightly smaller than the inside diameter of the carrier 16. Together, these disks 46, 48 generally maintain the charge holder 18 in the center of the carrier 16. The upper centralizer disk 46 lies between the helical strip 22 and the top crossover 54. Above the crossover 54 is a firing head 60 which contains the detonator 28. The lower end of the detonator 28 is coupled with the detonating cord 26 to form the ballistic connection. The upper end of the detonator 28 is coupled to the electrical connectors 27 of the electric wireline 3 in FIG. 1, forming an electrical connection between the wireline and detonator 28. Referring to FIGS. 2 & 3, in a preferred embodiment, the upper centralizing disk 46 has an upper centralizer disk alignment notch 58, such that this notch is aligned with the first charge 40.

The charge holder 18 is further comprised of the detonating cord 26. This detonating cord 26 is inserted through the apertures located on the dorsal end of each charge 24 and is attached to a conventional and commercially available detonation system 28. In the preferred embodiment, the detonating cord 26 is preferably, but not limited to, the type known commercially as Primacord®. The sealed charges 24 of the preferred embodiment are preferably, but not limited to the type commercially known as Capsule Charges. The detonating cord 26 is further inserted through small openings in the upper and lower centralizing disks 46, 48.

Referring to FIGS. 2-5B, the carrier 16 is an elongated tubular body. In the preferred embodiment, this elongated tubular body is made of steel and has an outside diameter of 4½ inches and an inside diameter of 3½ inches. However, the carrier 16 may be made of any other suitable material and may have other dimensions. For example, embodiments of the invention may have the following dimensions as well as others:

| OUTSIDE DIAMETER | INSIDE DIAMETER |
|---|---|
| 1 11/16 inches | 1¼ inch |
| 2⅛ inches | 1 27/32 inches |
| 3⅜ Inches | 2½ Inches |
| 4½ Inches (Pref. Embodiment) | 3½ inches (Pref. Embodiment) |
| 7 Inches | 6½ Inches |

Figure 7:
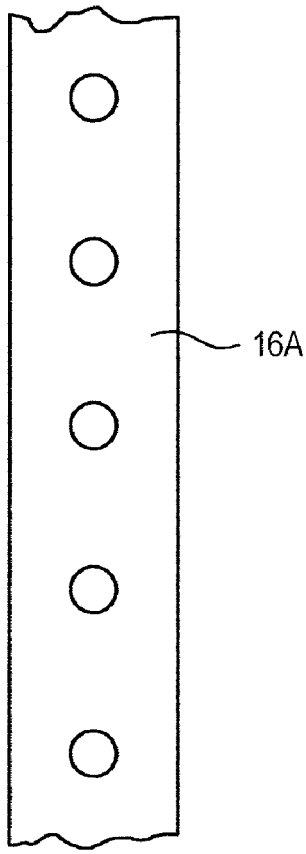
FIG. 7 is a side view of the perforation gun in accordance with another embodiment.

The carrier 16 has carrier openings 20 which allow charge blasts emitted from the sealed charges 24 to exit the carrier 16 without deforming the carrier 16 body. In the preferred embodiment, these openings 20 are spirally arranged to correspond to the spiral arrangement of the sealed charges 24. The openings 20 of the preferred embodiment are 1 inch in diameter. However, the opening 20 may be of varying diameters and need not be spirally arranged. For example, as shown in FIG. 7, in a zero degree phase, the openings 20 in the carrier 16A, are positioned vertically, and correspond with a vertical arrangement of the sealed charges 24.

Referring to FIGS. 2 & 3, the carrier 16 is further comprised of a through-hole, or notch 44 that forms a small opening 44 in a portion of the carrier 16. This point, in the preferred embodiment is aligned with the carrier opening 20 corresponding with the first charge 40. This notch 44, allows the user to insert the screw 42 into the upper charge holder centralizer disc 46 by threading it into the centralizer disc alignment notch 58. In this manner, the charge holder assembly 18 may be properly secured to the carrier 16.

The carrier 16 is closed at the bottom 56 (FIG. 4) with a bottom cap 52 (FIGS. 2 & 3). In the preferred embodiment this bottom cap 52 is a bull plug end cap 52. This bull plug 52 closes the bottom 56 of the carrier 16 and supports the charge holder assembly 18.

Figure 4:
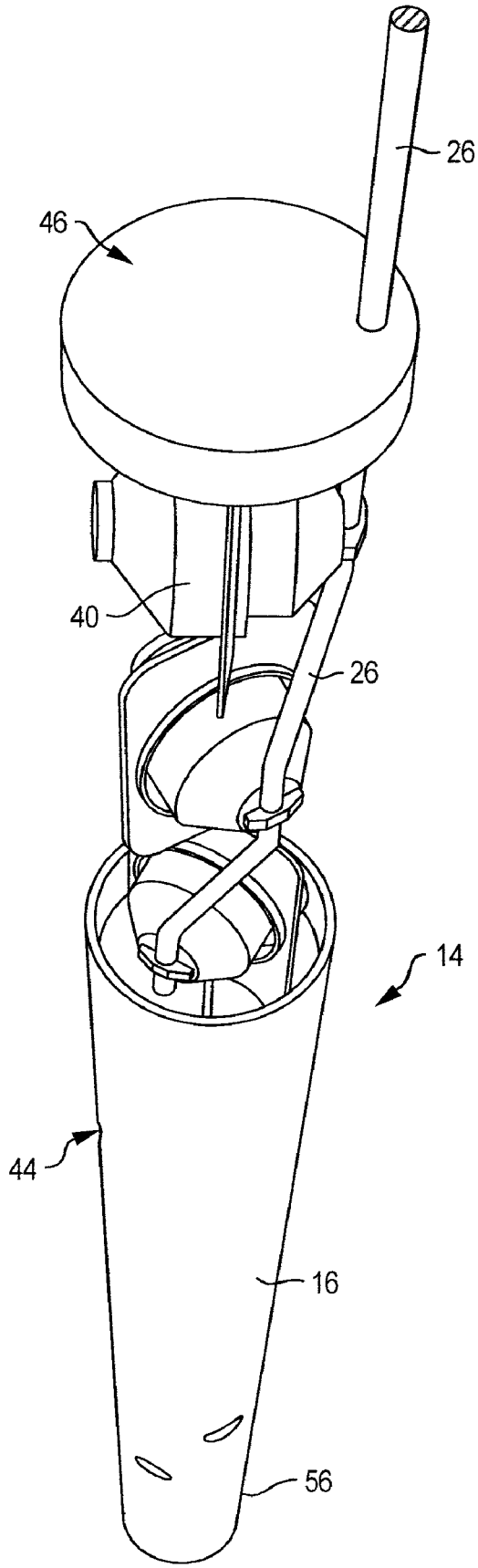
FIG. 4 is an isometric side and end view of the perforation gun, partially disassembled, and depicting the charge holder and charges partially inserted within the carrier, in accordance with a preferred embodiment.
Figure 5A:
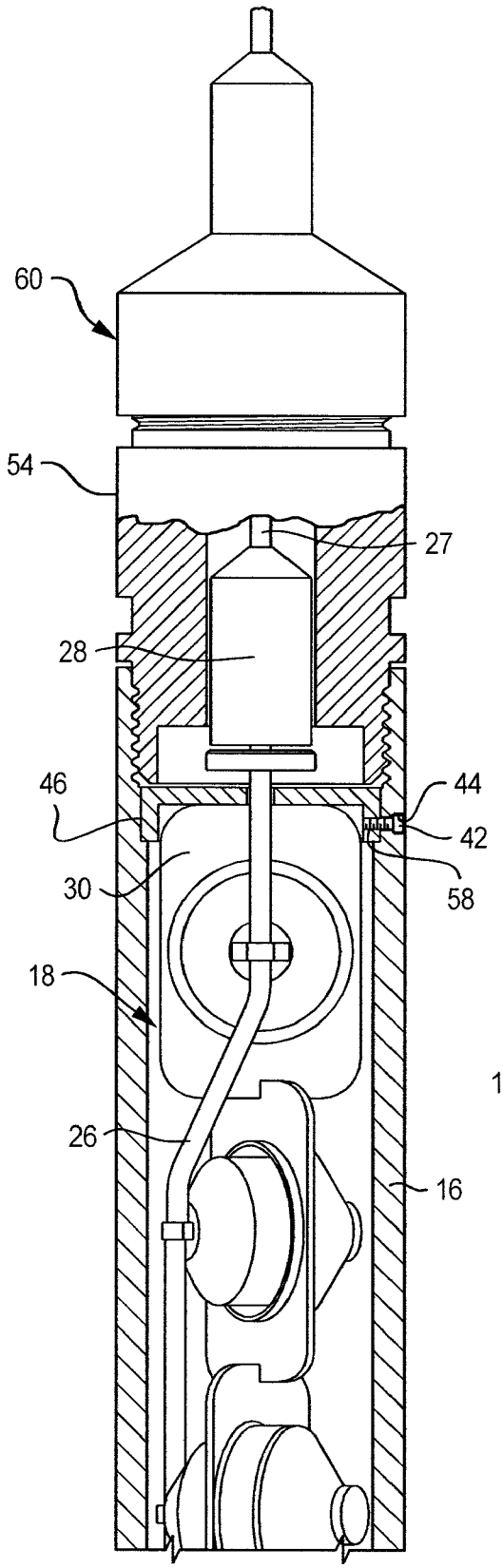
FIGS. 5A and 5B are cross-sectional views of the assembled perforation gun, in accordance with a preferred embodiment.
Figure 5B:
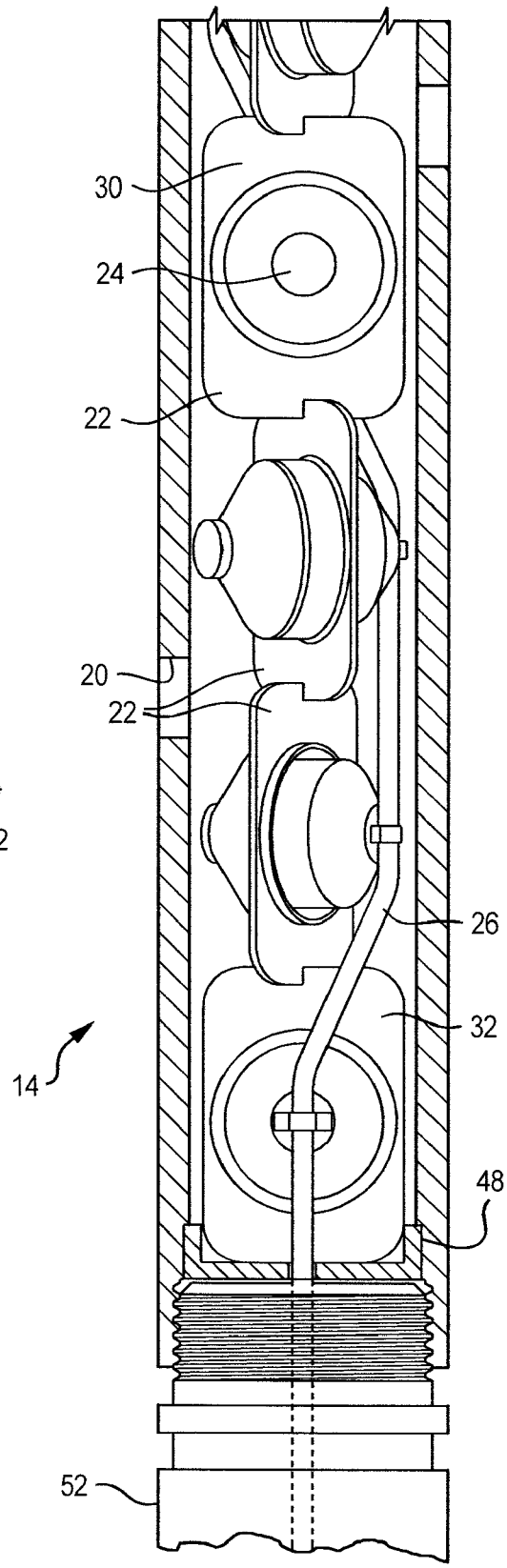

Referring to FIGS. 2-5B, the perforation gun 14 is assembled by inserting the lower centralizer disk 48 end of the assembled charge holder 18 into the top end of the carrier 16, as shown in FIG. 4. The charge holder 18 is inserted until the lower centralizer disk 48 rests against the bull plug cap 52. The charge holder 18 is rotated such that the charges 24 are aligned with the carrier openings 20. To properly align the charges 24 with the carrier openings 20, the charge holder 18 is rotated so that the upper centralizer disk alignment notch 58 is aligned with the carrier notch 44. When the upper centralizer disk alignment notch 58 is aligned with the carrier notch 44, the charge holder 18 is properly aligned and the charges 20 are aligned with the carrier openings 20. The alignment screw 42 may then be inserted and tightened such that the charge holder 18 is retained in the proper position. The top crossover 54 is then threadedly coupled to the carrier 16. The lower end of the detonator 28 is then coupled to the detonating cord 26 and the upper end is electrically coupled to the electrical cables 27 of the wireline 3. The detonator 28 is then placed within the firing head 60. The firing head 60 is then coupled to top crossover 54.

The operation and use of the perforation gun 14 will now be discussed. After the perforation gun 14 is assembled, it is lowered into the wellbore 2 by a wireline 3 (FIG. 1). Once the gun 14 is lowered to the desired position within the wellbore 2 adjacent to a producing formation 8, the detonation system 28 is activated, the detonating cord 26 is ignited and the charges 24 are fired. Each charge 24 then emits a charge blast that exits through the carrier openings 20, and perforates the well casing 4, cement 6 and producing formation 8, forming a perforation. Collectively, the perforations formed by each of the charge blasts allow fluids previously confined within the producing formation 8 to flow from the formation 8 into the wellbore 2. Any debris created as a result of the charge blasts collects at the base of the carrier 16 rather than at the base of the wellbore 2. After detonation, the perforation gun 14 is removed from the wellbore 2. The charge holder 18 and charge debris may then be removed from the carrier 16. The carrier 16 may then be reused.

The perforation gun 14 as described above is easily assembled and armed, permits a maximum amount of charge energy to penetrate the casing 4, cement 6 and formation 8, prevents debris from accumulating in the wellbore 2 after detonation, and has a reusable carrier 16 that is not deformed after detonation.

The foregoing disclosure and showings made in the drawings are merely illustrative of the principles of this invention and are not to be interpreted in a limiting sense. The scope of the invention is to be determined from the claims.

I claim:

1. A perforation gun comprising:

a tubular carrier having a length, an outer surface, an inner surface, and a plurality of openings, said openings extending from the outer surface to the inner surface such that said surfaces are in fluid communication with one another;

a plurality of sealed charges;

a charge holder capable of being secured within said carrier, the charge holder being comprised of a plurality of mounting locations, each capable of receiving one of said sealed charges such that said charges, when mounted within said mounting locations, are aligned with the openings in the carrier when the charge holder is secured within the carrier; and a detonating cord having a length, said detonating cord being coupled to at least one sealed charge.

2. The perforation gun of claim 1 wherein said openings are spirally arranged and spaced along the length of the carrier.

3. The perforation gun of claim 1 wherein said openings are vertically arranged and spaced along the length of the carrier.

4. The perforation gun of claim 1 wherein the carrier is closed at the top and bottom.

5. The perforation gun of claim 1 wherein said carrier is capable of capturing debris created by a charge blast emitted from the sealed charges.

6. The perforation gun of claim 1 wherein said carrier is not deformed after detonation.

7. The perforation gun of claim 1 wherein said carrier is reusable.

8. A perforation gun comprising:

a tubular carrier having a length, an outer surface, an inner surface, and a plurality of openings, said openings extending from the outer surface to the inner surface such that said surfaces are in fluid communication with one another, wherein said openings are spirally arranged and spaced along the length of the carrier;

a plurality of sealed charges;

a charge holder capable of being secured within said carrier, the charge holder being comprised of a plurality of plates, said plates being comprised of a plurality of mounting locations, each capable of receiving one of said sealed charges such that said charges, when mounted within said mounting locations, are aligned with the openings in the carrier when the charge holder is secured within the carrier;

a detonating cord having a length, said detonating cord being coupled to at least one sealed charge; and wherein said carrier is not deformed after detonation and is reusable.

* * * * *

UNITED STATES PATENT AND TRADEMARK OFFICE

CERTIFICATE OF CORRECTION

PATENT NO. : 7,762,351 B2
APPLICATION NO. : 12/250042
DATED : July 27, 2010
INVENTOR(S) : Maribel Vidal It is certified that error appears in the above-identified patent and that said Letters Patent is hereby corrected as shown below:

On the title page, item [76] should read --MARIBEL VIDAL--

Signed and Sealed this

Fifth Day of October, 2010

David J. Kappos

David J. Kappos
*Director of the United States Patent and Trademark Office*